US007003834B2

(12) United States Patent
Yamada et al.

(10) Patent No.: US 7,003,834 B2
(45) Date of Patent: Feb. 28, 2006

(54) COLOR-RECOVERING AGENT

(75) Inventors: Isao Yamada, Wakayama (JP); Norihiro Inoue, Wakayama (JP); Yoichi Tsukiyama, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/239,569

(22) PCT Filed: May 24, 2001

(86) PCT No.: PCT/JP01/04365

§ 371 (c)(1),
(2), (4) Date: Nov. 26, 2002

(87) PCT Pub. No.: WO01/90477

PCT Pub. Date: Nov. 29, 2001

(65) Prior Publication Data

US 2003/0141489 A1 Jul. 31, 2003

(30) Foreign Application Priority Data

May 25, 2000 (JP) ..... 2000-154525
May 25, 2000 (JP) ..... 2000-154526

(51) Int. Cl.
*D06B 1/00* (2006.01)

(52) U.S. Cl. ..... 8/147; 8/137; 8/901; 8/DIG. 1; 510/343

(58) Field of Classification Search ..... 524/588; 8/147, 137, 901, DIG. 1; 510/343
See application file for complete search history.

(56) References Cited

U.S. PATENT DOCUMENTS

| | | | | |
|---|---|---|---|---|
| 3,372,048 | A * | 3/1968 | Weissbein | 442/153 |
| 4,738,682 | A | 4/1988 | Boegh et al. | |
| 4,961,753 | A * | 10/1990 | Donkers et al. | 8/115.65 |
| 5,173,201 | A | 12/1992 | Coffindaffer et al. | |
| 5,415,857 | A * | 5/1995 | Robbins et al. | 424/70.122 |
| 5,503,755 | A | 4/1996 | Danner | |
| 5,516,822 | A | 5/1996 | Blanch et al. | |
| 6,040,288 | A * | 3/2000 | Popoff et al. | 510/466 |
| 6,077,317 | A * | 6/2000 | Murphy | 8/137 |
| 6,143,286 | A * | 11/2000 | Bhambhani et al. | 424/70.1 |
| 6,239,093 | B1 * | 5/2001 | Foley et al. | 510/352 |
| 6,726,731 | B1 * | 4/2004 | Pettifer et al. | 8/549 |
| 6,790,819 | B1 * | 9/2004 | Trinh et al. | 510/287 |
| 6,916,774 | B1 * | 7/2005 | Trinh et al. | 510/287 |

FOREIGN PATENT DOCUMENTS

| | | | |
|---|---|---|---|
| DE | 39 29 757 | A | 3/1991 |
| EP | 1 072 312 | A2 | 1/2001 |
| JP | 53-111192 | | 9/1978 |
| JP | 55-26232 | A | 2/1980 |
| JP | 62-174298 | | 7/1987 |
| JP | 63-145482 | A | 6/1988 |
| JP | 03 180578 | A | 8/1991 |
| JP | 31-80578 | A2 | 8/1991 |
| JP | 04 214482 | A | 8/1992 |
| JP | 5-508889 | A | 12/1993 |
| JP | 08 325952 | A | 12/1996 |
| JP | 10-96172 | A | 4/1998 |
| JP | 11 081147 | A | 3/1999 |
| JP | 2000-110077 | A | 4/2000 |
| WO | 98/17757 | | 4/1998 |

OTHER PUBLICATIONS

Kirk-Othmer: Encyclopedia of Chemistry Technology, Volumn 20, 1982, pp. 934-937.*
Grant & Hackh's Chemical Dictionary "Detergent" 1987.*

* cited by examiner

*Primary Examiner*—Margaret G. Moore
(74) *Attorney, Agent, or Firm*—Birch, Stewart, Kolasch & Birch, LLP

(57) ABSTRACT

This invention provides a composition and a means being capable of easily recovering the color of faded clothes in home. The composition is a color recovering agent which comprises (a) a water-insoluble polymer with a refractive index of 1.20 to 1.45 at 25° C., (b) a compound or polymer having a molecular weight of 300 to 1,000 having specific groups such as amide group, (c) water and (d) a non-aqueous solvent, wherein the ratio of (a)/(b) by weight is in the range of 3/1 to 100/1.

16 Claims, No Drawings

COLOR-RECOVERING AGENT

This application is the national phase under 35 U.S.C. §371 of PCT International Application No. PCT/JP01/04365 which has an International filing date of May 24, 2001, which designated the United States of America.

1. Technical Field of the Invention

This invention relates to a composition of a color-recovering agent for recovering the color of clothes having a colored pattern, which can be used generally in home.

2. Prior Arts

Fade of clothes having a colored pattern proceeds through repeated washing and wear under the influence of sunrays and chlorine in tap water. To recovery the color, the present applicants disclose, in JP-A No. 3-180578, an aerosol agent for deepening fiber colors. Such a composition can be sprayed to eliminate the luster of clothes caused by rubbing with hard surfaces of desks, chairs, etc. thereby deepening the color thereof.

Further, JP-A No. 53-111192 and JP-A No. 55-26232 disclose a method of industrially deepening the color of clothes by allowing a low-refractive compound to be adsorbed into stained clothes and heating or wet-heating the clothes, thereby deepening the color thereof.

On one hand, JP-A No. 10-96172 discloses a method of allowing silicone to be adsorbed into fibers. Further, JP-A No. 5-508889 discloses a composition for a cloth softener agent comprising amino-modified silicone. However, the object of these inventions is to confer smoothness and water repellency on clothes, but not to improve the color of clothes.

Further, JP-A No. 62-174298 describes treatment of faded clothes with an aqueous solution containing cellulase to recover the color of the clothes, but the effect is not satisfactory.

DISCLOSURE OF THE INVENTION

The object of this invention is to provide an agent, which in home can easily recover the color of clothes faded by repeated washing, etc.

This invention relates to a color-recovering agent composition which comprises (a) a water-insoluble polymer with a refractive index of 1.20 to 1.45 at 25° C., (b) at least one compound selected from components (i) and (ii) below defined and (c) water, wherein the ratio by weight of (a)/(b) is in the range of 3/1 to 100/1:

(i) a compound with a molecular weight of 300 to 1,000 having, in the molecule thereof, at least one member selected from the group consisting of an amide group, an ester group, a quaternary ammonium group and a tertiary amino group and at least one of a $C_{10-36}$ alkyl or alkenyl group, and (ii) a polymer or copolymer derived from at least one ethylenically unsaturated compound having at least one member selected from the group consisting of an amide group, a carboxylic acid group, a hydroxyl group, a quaternary ammonium group and a tertiary amino group.

In one aspect of this composition, the component (a) is a water-insoluble silicone compound, and the component (b) is a compound with a molecular weight of 300 to 1,000 having, in the molecule thereof, at least one of a quaternary ammonium group and a tertiary amino group and at least one of a $C_{10-36}$ alkyl group and a $C_{10-36}$ alkenyl group.

In the composition of this invention, the component (a) is preferably a fluorine-containing polymer or a silicone compound.

The composition can further comprise (d) a non-aqueous medium or (e) an emulsifier. The composition of this invention may also be a composition comprising the components (a), (b), (c), (d) and (e) described above.

As used herein, "refractive index" is the one measured by an Abbe refractometer, and "water-insoluble" refers to a solubility of not higher than 1 g/L ion-exchanged water at 20° C.

DETAILED DESCRIPTION OF THE INVENTION

Hereinafter, this invention is described in more detail.

Component (a)

The component (a) in this invention is a water-insoluble polymer having a refractive index at 25° C. of 1.20 to 1.45, preferably 1.25 to 1.45, and particularly preferably 1.30 to 1.43. When the refractive index is in this range, a sufficient color-recovering effect can be obtained, and color can also be made suitable. A water-soluble polymer cannot give the color-recovering effect achieved by the water-insoluble polymer of this invention.

The polymer satisfying the properties described above is preferably a fluorine-containing polymer and a silicone compound. The fluorine-containing polymer is preferably a polymer or copolymer of at least one monomer selected from trifluoroethyl acrylate (or methacrylate), pentadecafluorooctyl acrylate (or methacrylate), tetrafluoroethylene, trifluorochloroethylene, trifluoroethyl acrylate (or methacrylate), hexafluoropropylene, tetrafluoroethylene oxide and hexafluoropropylene oxide, or modified silicone containing an organic group including a fluoroalkyl group, fluoroalkylene group or fluoroaryl group as described later (referred to hereinafter as fluorine-modified silicone) For the effect of recovering color, these polymers preferably have a weight-average molecular weight of 1,000 to 1,000,000, preferably 1,500 to 500,000 as determined by gel permeation liquid chromatography using polystyrene as the standard with dimethylformamide as the development solvent.

The fluorine type compound can be obtained by an usual radical polymerization reaction when the monomer is an ethylenically unsaturated compound, or by an usual addition reaction when the monomer is an alkylene oxide compound. The radical polymerization reaction may be bulk polymerization, solution polymerization or emulsion polymerization. The polymerization initiator used may be 2,2'-azobis (2-amidinopropane), azobisisobutyronitrile, di-t-butyl peroxide, hydrogen peroxide, t-butyl hydroperoxide, cumene hydroperoxide, methyl ethyl ketone peroxide, cyclohexanone peroxide, peracetic acid, perbenzoic acid, lauroyl peroxide or persulfate.

The addition reaction of the alkylene oxide compound can be easily carried out in the presence of a catalyst a usually used alkali such as sodium hydroxide or potassium hydroxide or Lewis acid such as boron trifluoride.

In this invention, the fluorine type polymer may be a copolymer containing copolymerizable monomers other than fluorine-containing monomers, wherein the molar ratio of fluorine-containing monomers to the total monomers is 0.5 or more, preferably 0.6 or more, for the effect of recovering color.

When the fluorine-modified silicone is used, the viscosity thereof at 25° C. is 100,000 to 200,000 $mm^2/s$, preferably 500,000 to 100,000 $mm^2/s$ and particularly preferably 500 to 80,000 $mm^2/s$, for the effect of recovering color. The viscosity can be measured, for example, by an Ubbellohde U-shaped viscometer.

In this invention, a silicone compound can also be used as the component (a). The silicone compound is an organopolysiloxane oil having refractive index and solubility in the above-specified ranges, and specifically mention is made of a dimethyl polysiloxane oil (referred to hereinafter as dimethyl silicone), an organopolysiloxane oil derived from dimethyl silicone oil by replacing some methyl groups in side chains or in terminals thereof by hydroxyl groups (referred to hereinafter as hydroxy silicone) or an organopolysiloxane oil derived from the dimethyl silicone oil or hydroxy silicone by replacing some methyl groups (preferably some methyl groups in side chains) by "organic groups other than methyl groups" (referred to hereinafter as modified silicone). The modified silicone is illustrated mainly in chapter 6 in Silicone Handbook (first edition, edited by Kunio Ito and published on Aug. 31, 1990 by the Nikkan Kogyo Shimbun, Ltd.). The organic groups other than methyl groups include organic groups including an amino group, organic groups including an amide group, organic groups including a polyether group, organic groups including an epoxy group, organic groups including a carboxy group, organic groups including an alkyl group and organic groups including a halogenoalkyl group, halogenoalkylene group or halogenoaryl group, as well as organic groups including a poly(N-acylalkylene imine) chain. The silicone compound in this invention is preferably modified silicone having organic groups including an amino group (referred to hereinafter as amino-modified silicone), modified silicone having-organic groups including a poly(N-acylalkylene imine) chain or modified silicone having organic groups including a halogenoalkyl group, halogenoalkylene group or halogenoaryl group (halogeno-modified silicone), more preferably amino-modified silicone or halogeno-modified silicone having an amino equivalent of 1,500 to 40,000 g/mol, preferably 2,500 to 20,000 g/mol and particularly preferably 3,000 to 10,000 g/mol, and most preferably amino-modified silicone.

The silicone compound used is preferably modified silicone having organic groups including an amino group or a poly(N-acylalkylene imine) chain, more preferably modified silicone having an amino group or a poly(N-acylalkylene imine) chain bound via a $C_{2-8}$ alkylene group to a side chain of the polysiloxane chain.

When modified silicone having water-soluble organic groups is used in this invention, the one modified to have a solubility of 1 g or less/L of ion-exchanged water is selected.

The silicone compound (excluding fluorine-modified silicone) in this invention is a compound having a weight-average molecular weight of preferably 1,000 to 1,000,000, more preferably 3,000 to 500,000 and most preferably 5,000 to 250,000 as determined by gel permeation liquid chromatography using polystyrene as the standard with chloroform as the development solvent. The viscosity thereof is preferably 10 to 100,000 $mm^2/s$, more preferably 500 to 50,000 $mm^2/s$ and most preferably 1,000 to 40,000 $mm^2/s$. The viscosity can be measured, for example, by an Ubbellohde U-shaped viscometer.

Component (b)

The component (b) in this invention is a compound selected from the following (i) or (ii):

(i) a compound with a molecular weight of 300 to 1,000 having, in the molecule thereof, at least one member selected from the group consisting of an amide group, an ester group, a quaternary ammonium group or a tertiary amino group and at least one of a $C_{10-36}$ alkyl group and alkenyl group, and (ii) a polymer or copolymer derived from at least one ethylenically unsaturated compound having at least one member selected from the group consisting of an amide group, a carboxylic acid group, a hydroxyl group, a quaternary ammonium group or a tertiary amino group.

The compound (i) is particularly preferably (i-1) a quaternary ammonium salt of the general formula (2) below, (i-2) a tertiary amine compound of the general formula (3) or (4) below, (i-3) an ester compound of a $C_{2-10}$ polyvalent alcohol with a $C_{10-20}$ fatty acid, (i-4) an amide compound of a polyvalent carboxylic acid with a secondary amine having a $C_{10-20}$ alkyl group, and (i-5) an amide compound of a $C_{10-20}$ fatty acid with an alkylene diamine, dialkylene triamine or hydroxyalkyl alkylene diamine.

(2)

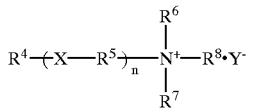

wherein $R^4$ represents a $C_{10-36}$, preferably $C_{10-24}$, more preferably $C_{12-18}$ alkyl or alkenyl group, $R^6$ and $R^7$each represent a $C_{1-3}$ alkyl group or hydroxyalkyl group or $R^4$—$(X—R^5)_n$—; $R^8$ represents a $C_{1-3}$ alkyl group or hydroxyalkyl group; X is a group selected from —COO—, —OCO—, —$CONR^9$— and —$NR^9CO$—; $R^5$ represents a $C_{1-5}$, preferably $C_{1-3}$ alkylene group; $R^9$ represents a hydrogen atom or a $C_{1-3}$ alkyl group or hydroxyalkyl group; n is an integer of 1 or 0; and $Y^-$ is an inorganic or organic anion, preferably a halogen ion, sulfate ion, phosphate ion, $C_{1-3}$ alkyl sulfate ion, $C_{1-12}$ fatty acid ion, more preferably a halogen ion and $C_{1-3}$ alkyl sulfate ion.

(3)

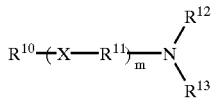

wherein $R^{10}$ represents a $C_{10-36}$, preferably $C_{10-24}$, more preferably $C_{12-18}$ alkyl or alkenyl group; $R^{12}$ and $R^{13}$ each represent a $C_{1-3}$ alkyl group or hydroxyalkyl group or $R^{10}$—$(X—R^{11})_m$—; X is a group selected from —COO—, —OCO—, —$CONR^9$— and —$NR^9CO$—; $R^{11}$ represents a $C_{1-5}$, preferably $C_{1-3}$ alkylene group; m is an integer of 1 or 0; and $R^9$ represents a hydrogen atom or a $C_{1-3}$ alkyl group or hydroxyalkyl group.

(4)

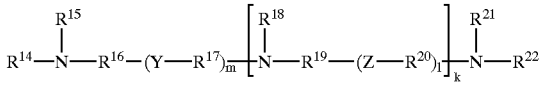

wherein $R^{14}$, $R^{15}$, $R^{18}$, $R^{21}$ and $R^{22}$ independently represent a hydrogen atom, a $C_{1-5}$ alkyl group or hydroxyalkyl group or $R^{23}$—$(W—R^{24})_1$—, and at least one of $R^{14}$, $R^{15}$, $R^{18}$, $R^{21}$ and $R^{22}$ is $R^{23}$—$(W—R^{24})_1$—, whereupon $R^{23}$ is a $C_{10-36}$ alkyl group, and $R^{24}$ is a $C_{1-5}$ alkylene group; W is —COO—, —OCO—, —$CONR^{25}$—, —$NR^{25}CO$—, or —O—, and W and $R^{24}$ in $R^{23}$—$(W—R^{24})_1$— bound to each N atom may be the same or different; $R^{25}$ represents a hydrogen atom, a $C_{1-3}$ alkyl group or hydroxyalkyl group; $R^{16}$, $R^{17}$, $R^{19}$ and $R^{20}$ each represent a $C_{1-5}$ alkylene group; each of 1 and m is a number of 0, 1 or 2; Y and Z may be the same or different and each represent a group selected from —COO—, —OCO—, —CONR$^{26}$—, —NR$^{26}$CO—, —O— and —CH (OR$^{27}$)—; $R^{26}$ and $R^{27}$ each represent a hydrogen atom or a $C_{1-5}$ alkyl group or hydroxyalkyl group; and k is a number of 0 to 10 on average.

The ester compound (i-3) of a $C_{2-10}$ polyvalent alcohol with a $C_{10-20}$ fatty acid is preferably a mono-, di- tri- and/or tetra-ester of a $C_{10-22}$, preferably $C_{10-20}$, more preferably $C_{12-18}$ saturated or unsaturated fatty acid with glycerin, pentaerythritol, sorbitol, ethylene glycol, propylene glycol, diethylene glycol or dipropylene glycol, or a mixture of such esters, or glyceryl ether or diglyceryl ether having at least one $C_{10-20}$, preferably $C_{12-18}$ alcohol added thereto, or a mixture thereof, or an ester compound of a $C_{10-20}$, preferably $C_{12-18}$ fatty acid with a $C_{1-20}$, preferably $C_{1-18}$ alcohol. Among these, ester compounds of glycerin, pentaerythritol or sorbitol with a $C_{12-18}$ fatty acid, or a mixture thereof, are preferable.

The amide compound (i-4) of a polyvalent carboxylic acid with a primary amine includes amide compounds of a $C_{10-20}$, preferably $C_{12-18}$ primary amine with a polyvalent carboxylic acid selected from oxalic acid, glutaric acid, succinic acid, maleic acid, fumaric acid, valeric acid, adipic acid, azelaic acid, sebacic acid, brassylic acid, dodecane diacid, tricarballylic acid, 1,2,3-propane dicarboxylic acid, citric acid, malic acid and tartaric acid.

The amide compound (i-5) of a $C_{10-20}$ fatty acid with ethylene diamine, diethylene triamine or hydroxyethyl ethylene diamine is also good. The amine compound may be fully or partially amidated.

The compound belonging to (i) in this invention is particularly preferably (i-1), (i-2) and (i-3) for the effect of recovering color, more preferably (i-1) and (i-2).

Further, the compound (ii) is preferably a polymer or copolymer having a weight-average molecular weight of 1,000 to 2,000,000, preferably 3,000 to 1,500,000 (as determined by gel permeation chromatography using polyethylene glycol as the standard) obtained by a polymerization reaction usually using at least one member selected from amide type monomers such as acrylamide, methacrylamide, crotonic acid amide and vinyl pyrrolidone, carboxylic acid type monomers such as acrylic acid, methacrylic acid and maleic acid, hydroxyl type monomers such as polyvinyl alcohol, quaternary ammonium type monomers such as acryloyl aminopropyl trialkyl ammonium salt, methacryloyl aminopropyl trialkyl ammonium salt, acryloyloxyethyl trialkyl ammonium salt, methacryloyloxyethyl trialkyl ammonium salt, dialkyl diallyl ammonium salt and trialkyl allyl ammonium salt, and amine type monomers such as acryloyl aminopropyl dialkyl amine, methacryloyl aminopropyl dialkyl amine, acryloyloxyethyl dialkyl ammonium salt, and methacryloyloxyethyl dialkyl amine, particularly preferably a polymer or copolymer having a weight-average molecular weight of 5,000 to 1,500,000, preferably 10,000 to 1,000,000 containing at least one of the above amide type monomers and quaternary ammonium type monomers in an amount of 20 to 100 mole %, preferably 40 to 100 mole % in the polymer.

The above-mentioned (ii) may be a copolymer of the above ethylenically unsaturated monomer with a copolymerizable unsaturated monomer, and such an unsaturated monomer includes alkyl (meth)acrylate, ethylene, propylene, butadiene, styrene and fatty acid vinyl. For the effect of recovering color, the copolymerizable unsaturated monomer is contained in an amount of less than 50 mole %, preferably less than 30 mole % and particularly preferably less than 10 mole % in the copolymer (ii).

For the effect of recovering color, the color-recovering agent of this invention preferably comprises the component (a) in an amount of 1 to 30% by weight, particularly 2 to 20% by weight, and the component (b) in an amount of 0.1 to 10% by weight, particularly 0.2 to 5% by weight. Further, the ratio by weight of (a)/(b) is preferably 3/1 to 100/1, more preferably 3/1 to 50/1, most preferably 4/1 to 25/1.

Component (c)

The component (c) in this invention is preferably water from which heavy metals ion and hard-water components had been removed, particularly preferably ion-exchanged water or distilled water. Desirably, the color recovery agent of this invention comprises the component (c) in an amount of 40 to 95% by weight, preferably 50 to 90% by weight and more preferably 60 to 90% by weight for storage stability.

Component (d)

The component (d) in this invention includes ethylene glycol, propylene glycol, diethylene glycol, dipropylene glycol, alkyl glyceryl ether, di- or trialkylene glycol monoalkyl ether, di- or trialkylene glycol monoallyl ether, triethylene glycol monoallyl ether, glycerine, 1, 6-hexane diol, 2,5-hexane diol, cyclohexanol, 2-hexanol and 1-octanol.

Among these, ethylene glycol, propylene glycol, diethylene glycol, dipropylene glycol, $C_{3-8}$ alkyl glyceryl ethers, di- or trialkylene glycol mono- or diallyl ether, and di- or triethylene glycol mono- or diphenyl ether are particularly preferable. In particular, at least one member selected from ethylene glycol, propylene glycol, ethanol and propanol is compounded preferably for the effect of recovering color and storage stability. The color-recovering agent of this invention comprises the component (d) in an amount of preferably 0.1 to 20% by weight, more preferably 0.5 to 10% by weight.

Emulsifier (Referred to Hereinafter as Component (e))

Because the component (a) in this invention is water-insoluble, an emulsifier is preferably blended for the purpose of emulsification and dispersion in the color-recovering agent. A part of the component (b) acts as an emulsifier. Further, the composition preferably contains an emulsifier other than the component (b).

The component (e) as the emulsifier includes anionic surfactants such as alkyl benzene sulfonic acids or salts thereof, alkyl sulfates, polyoxyalkylene alkyl ether sulfates, olefin sulfonates, alkane sulfonates and fatty acid salts, nonionic surfactants such as polyoxyalkylene alkyl or alkenyl ethers, polyoxy alkylene alkyl phenyl ethers, fatty acid alkanol amides or alkylene oxide adducts thereof, sucrose fatty acid esters and alkyl glucosides, and amphoteric surfactants such as amine oxides, sulfobetaine and carbobetaine.

A polyoxyalkylene alkyl ($C_{8-20}$) or alkenyl ($C_{8-20}$) ether having 5 to 100 molecules on average of alkylene oxide added thereto is preferable.

Specifically, the emulsifier in this invention is particularly preferably a nonionic surfactant represented by the general formula (1):

$$R^1—O—(R^2O)_p—H \quad (1)$$

wherein $R^1$ is a $C_{8-20}$, preferably $C_{10-20}$ alkyl group or alkenyl group; $R^2$ is a $C_{2-3}$ alkylene group, preferably an ethylene group; and p is a number of 2 to 200, preferably 5 to 100, more preferably 5 to 80.

The compound of the general formula (1) includes the following compounds:

$$R^3—O—(C_2H_4O)_r—H$$

wherein $R^3$ is a $C_{10-18}$ alkyl group, r is a number of 5 to 60, preferably 5 to 40;

$$R^3—O—(C_2H_4O)_s(C_3H_6O)_t—H$$

wherein $R^3$ has the same meaning as defined above; s and t independently represent a number of 2 to 40, preferably 2 to 40, and the sum of s and t is a number of 5 to 60; and ethylene oxide and propylene oxide may be added in a random or block manner.

The ratio by weight of component (e)/component (a) in this invention is preferably 1/1,000 to 2/1, more preferably 5/1,000 to 1/1, particularly preferably 1/100 to 1/1 for emulsification and dispersion stability. The diameter of the emulsified particles in the color-recovering agent is 0.01 to 5 μm, preferably 0.02 to 3 μm and particularly preferably 0.01 to 1 μm for color recovery.

Other components such as perfumes, bactericides, antifungus agents, pigments, and viscosity regulators may be incorporated into the color-recovering agent of this invention insofar as the effect of this invention is not deteriorated.

Composition

The color-recovering agent of this invention is used in the form of a dispersion prepared by diluting the components (a), (b) and preferably (d) with water [component (c)].

The pH value (at 20° C.) of the color-recovering agent of this invention is 2 to 9, preferably 3 to 8.0, for storage stability and the effect of recovering color.

Further, this invention also relates to a color recovering composition which comprises (a) a water-insoluble polymer with a refractive index of 1.20 to 1.45 at 25° C., (b) a compound with a molecular weight of 300 to 1,000 having at least one of a quaternary ammonium group and a tertiary amino group and at least one of a $C_{8-36}$ or $C_{10-36}$ alkyl group and a $C_{8-36}$ or $C_{10-36}$ alkenyl group, and (c) water. The composition preferably comprises the component (a) in an amount of 5 to 50% by weight, particularly 2 to 20% by weight and the component (b) in an amount of 1 to 10% by weight, particularly 1 to 5% by weight for the effect of recovering color. Further, the ratio by weight of (a)/(b) is in the range of preferably 3/1 to 100/1, more preferably 3/1 to 50/1 and most preferably 4/1 to 25/1.

Using Method

The color-recovering agent of this invention may be used by soaking faded clothes therein or by adding it to a neutral detergent or to a generally used weakly alkaline detergent in washing of clothes, or by adding it to rinsing water after clothes are washed with a detergent, whereby the color of the clothes with a patterned color can be easily recovered. When used together with a detergent, the color-recovering agent is used at a concentration of preferably 0.01 to 2% by weight, particularly preferably 0.033 to 0.5% by weight in the washing solution. When added to rinsing water, the color-recovering agent is used at a concentration of preferably 0.001 to 0.3% by weight, particularly preferably 0.01 to 0.2% by weight in the washing solution, whereby the effect of recovering color can be achieved efficiently.

In this invention, clothes are soaked in an aqueous medium prepared by dissolving or dispersing the components (a) and (b) and the arbitrary component in water. The concentration of the component (a) in the aqueous medium is 5 to 2,500 ppm, preferably 30 to 800 ppm, more preferably 50 to 800 ppm.

Further, the concentration of the component (b) in the aqueous medium is 1 to 800 ppm, particularly 2 to 500 ppm, particularly preferably 5 to 500 ppm.

Further, the pH value at 20° C. of the aqueous medium used in this invention is 5 to 11, preferably 6 to 10.5, particularly preferably 7.5 to 10.5 in respect of the effect of recovering color.

The aqueous medium used in this invention may contain a commercial weakly alkaline detergent, a softener or a detergent such as a textile size or a fiber-treating agent in addition to the color-recovering agent, and the concentration of these detergents or the fiber-treating agent is desirably 900 ppm or less, preferably 700 ppm or less, particularly preferably 500 ppm or less, to achieve the color-recovering effect effectively.

In this invention, faded clothes are soaked in the aqueous medium in a bath ratio of 1/2 to 1/500, preferably 1/5 to 1/100. As used herein, the "bath ratio" refers to the ratio by weight of clothes to the aqueous medium, that is, bath ratio=clothes/aqueous medium (ratio by weight). Soaking refers to soaking completely clothes, and the clothes may be soaked in the stationary aqueous medium or in the aqueous medium under stirring. The soaking time is 1 to 180 minutes, preferably 5 to 120 minutes, particularly preferably 5 to 30 minutes. Further, the temperature of the aqueous medium is 5 to 50° C., more preferably 10 to 40° C. After soaking, the clothes are dehydrated and air-dried or dried in an automatic drier. After drying, the clothes may be ironed.

EXAMPLE 1

Preparation of the Color-Recovering Agent

Using the components (a-1) to (e-1) shown below, the compositions in Table I-1 were prepared. Each color-recovering agent was prepared by mixing the components in a total weight of 200 g in the ratio shown in Table 1 in a 200-ml beaker and stirring the mixture for 4 hours at 300 r/min with a stainless steel agitating blade of 30 mm in diameter. The diameter of particles in each color-recovering agent thus emulsified was in the range of 0.02 to 2 μm. The particle diameter was measured with a light-scattering photometer ELS-800 manufactured by Ohtsuka Denshi Co., Ltd.

(a-1): Polytetrafluoroethyl acrylate (with a refractive index of 1.37 and a molecular weight of 170,000, prepared by radical polymerization of tetrafluoroethyl acrylate by azobisisobutyronitrile as the initiator)

(a-2): Polyoxyhexafluoropropylene (Fonburin Y25, with a refractive index of 1.30 and an average molecular weight of 3000, Nippon Montedison)

(a-3): Fluorine-modified silicone (SH1265, with a refractive index of 1.38 and a viscosity of 10,000 $mm^2/s$, Toray Dow Corning)

(a'-1): Modified silicone having organic groups having polyether group (TFS4453, with a refractive index of 1.46 and a viscosity of 1,000 $mm^2/s$, Toray Dow Corning)

(a'-2): Polymethyl methacrylate (with a refractive index of 1.49 and a molecular weight of 150,000, prepared by radical polymerization of methyl acrylate by azobisisobutyronitrile as the initiator)

(b-1): N-stearoyl aminopropyl-N,N,N-trimethyl ammonium chloride (b-2): N-myristyloyloxyethyl-N,N-dimethyl ammonium chloride (b-3): The compound obtained in Production Example 1 below, represented by the following formula:

R—NH—$(C_2H_4NH)_n$—H wherein R is a hydrocarbon group derived from palm seed oil.

PRODUCTION EXAMPLE 1

21.4 g (0.139 mole) diethyl sulfate and 1.39 moles of 2-oxazoline were dissolved in 700 g dehydrated ethyl acetate in a 2-L four-necked flask and then heated under reflux for 5 hours in a nitrogen atmosphere. Then, 444 g (1.11 moles) solution of 50% primary amine having an alkyl composition derived from palm seed oil in ethyl acetate was added thereto, and after the mixture was heated under reflux for 10 hours, the ethyl acetate was distilled away under reduced pressure from the reaction mixture. Then, amide linkages in 400 g of the resultant compound were hydrolyzed, and propionic acid produced as a byproduct was removed, whereby compound (b-3) was obtained. The average degree of polymerization thereof was 8 moles and the yield was 95%.

(b-4): Dimethyl diallyl ammonium chloride polymer (Marcoat 100, with a molecular weight of 200,000, produced by Cargon)

(b-5): Dehydrating esterification reaction product of 1 mole of glycerin and 2 moles of fatty acid having a hardened tallow composition (b-6): Dehydrating amidation reaction product of 1 mole of citric acid and 2 moles of stearyl amine (b-7): Dehydrating condensation reaction product of 1 mole of hydroxy ethyl ethylene diamine and 2 moles of fatty acid having a hardened tallow composition (d-1): Ethylene glycol (e-1): Adduct having 3 moles of ethylene oxide, 3 moles of propylene oxide and 2 moles of ethylene oxide added to lauryl alcohol in this order in a block form

Preparation of Faded Clothes

Commercial two black cotton polo shirts were washed with a weakly alkaline detergent in a washing machine (two-chamber washing machine VH-360S1 produced by Toshiba; detergent concentration, 0.0667% by weight; tap water, 30 L; water temperature, 20° C.; washing for 10 minutes, dehydration for 1 minute, and rinsing for 5 minutes with 30 L running tap water). After this procedure was carried out 5 times, the clothes lost the initial color, to turn whitish as a whole. The clothes were used as faded clothes. The weakly alkaline detergent used had an average particle diameter of 500 $\mu$m (from which particles of 125 $\mu$m or less in diameter and particles of 1,000 $\mu$m or more in diameter had been removed), an apparent bulk density of 700 g/cm$^3$and a composition consisting of 22 weight % sodium linear ($C_{12-13}$) alkylbenzene sulfonate, 5weight % sodium lauryl sulfate, 4 weight % sodium myristate, 5 weight % polyoxyethylene lauryl ether (having 8 molecules on average of ethylene oxide added thereto), 8 weight % sodium silicate No. 1, 5 weight % sodium polyacrylate (weight average molecular weight: 10,000), 15 weight % type A zeolite, 15 weight % sodium carbonate (soda ash) 3 weight % potassium carbonate, 0.5 weight % protease (Sabinase 12.0T type-W, produced by Novonordisk), 0.5 weight % cellulase (KAC500 produced by Kao Corporation) and 17 weight % sodium sulfate anhydride ("weight %" is based on the weight (excluding 7 weight % volatiles) of the detergent.).

Treatment Method 1

One suit of the above faded clothes was soaked for 4 minutes in an aqueous solution containing 0.3 weight % color-recovering agent in Table 1, dehydrated for 1 minute, then subjected twice to rinsing for 2 minutes and dehydration for 1 minute, dehydrated again, and dried in a thermostatic chamber at 25° C. under 50% humidity for 12 hours. After this treatment, the recovery of the color of the clothes was compared with the faded clothes as the control before the treatment by a panel of 10 persons (males in their thirties) under a white fluorescent lamp and evaluated under the criteria shown below. ○ was given to an average point of less than 1, □ to 1.0-1.2, Δ to 1.2-1.5, and × to 1.5 or more.

Evaluation Criteria

0: Near to the color of new clothes.

1: Seems more vivid in color than the control.

2: Seems equal to the control.

3: Seems more faded than the control.

Treatment Method 2

The above faded clothes were washed with a combination of a weakly alkaline detergent (the same as the one used in preparation of the faded clothes; the concentration of the detergent, 0.0667 weight %) and the color-recovering agent (0.3 weight %) in Table 1 (two-chamber washing machine VH-360S1 produced by Toshiba; 30 L tap water was used; water temperature, 20° C.; washing for 10 minutes, dehydration for 1 minute, rinsing for 5 minutes with 30 L running tap water). After this procedure was repeated 5 times, the faded clothes were compared with the faded clothes (control) washed 5 times without using the color-recovering agent in Table 1 and evaluated in the same manner as in treatment method 1. The results are shown in Table I-1.

TABLE I-1

| | | | Products of the invention | | | | | | | Comparative products | | | |
|---|---|---|---|---|---|---|---|---|---|---|---|---|---|
| | | | 1 | 2 | 3 | 4 | 5 | 6 | 7 | 1 | 2 | 3 | 4 |
| Color-recovering agent | Compounded components (weight %) | a-1 | 10 | | | 15 | | | | | | 10 | |
| | | a-2 | | 10 | | | 10 | | 10 | | | | 10 |
| | | a-3 | | | 10 | | | 20 | | | | | |
| | | a'-1 | | | | | | | | 10 | | | |
| | | a'-2 | | | | | | | | | 10 | | |
| | | b-1 | | | | | | | 1 | | | | |
| | | b-2 | | | 1 | | | | | | | | |

TABLE I-1-continued

| | Products of the invention | | | | | | | Comparative products | | | |
|---|---|---|---|---|---|---|---|---|---|---|---|
| | 1 | 2 | 3 | 4 | 5 | 6 | 7 | 1 | 2 | 3 | 4 |
| b-3 | | 2 | | | | | | 2 | 2 | | |
| b-4 | 1 | | | | | | | | | 5 | |
| b-5 | | | | 5 | | | | | | | |
| b-6 | | | | | 1 | | | | | | |
| b-7 | | | | | | 1 | | | | | |
| d-1 | 2 | 2 | 2 | 2 | 2 | 2 | 2 | 2 | 2 | 2 | 2 |
| e-1 | 1 | 1 | 1 | 1 | 1 | 1 | 1 | 1 | 1 | 1 | 1 |
| Ion-exchanged water | balance | balance | balance | balance | balance | balance | balance | balance | balance | balance | balance |
| Total | 100 | 100 | 100 | 100 | 100 | 100 | 100 | 100 | 100 | 100 | 100 |
| pH (20° C.) | 7 | 4 | 4 | 4 | 5 | 6 | 4 | 4 | 7 | 7 | 4 |
| (a)/(b) ratio by weight | 10/1 | 5/1 | 10/1 | 3/1 | 10/1 | 20/1 | 10/1 | 5/1 | 5/1 | 2/1 | — |
| Treatment method | Method 2 | Method 1 | Method 1 | Method 2 | Method 2 | Method 1 | Method 1 | Method 1 | Method 2 | Method 2 | Method 1 |
| Evaluation result | ○ | ○ | ○ | ○ | ○ | ○ | ○ | Δ | Δ | Δ | X |

(Note)
The pH was adjusted with 0.1 N aqueous acetic acid or 0.1 N aqueous sodium hydroxide.
The particle diameter of the particles in each color-recovering agent in an emulsified state was in the range of 0.02 to 2 μm.
In Comparative Products 1 and 2, the ratio of a'-1 to a'-2 is expressed as (a)/(b) for convenience' sake.

Treatment Method 3

One suit of the above faded clothes was subjected to washing/rinsing with running waster in the same manner as described above, and when rinsing (2) was initiated, 20 g of each of Products 1 to 7 of the Invention was added, and the clothes were stirred for 2 minutes. Thereafter, the clothes were dehydrated and dried in a thermostatic chamber at 25° C. under 50% humidity for 12 hours. After this procedure was repeated 7 times, the faded clothes were compared with the faded clothes (control) washed 7 times without using the color-recovering agent in Table I-1 and evaluated under the evaluation criteria in treatment method 1, and as a result, the same excellent color-recovering effect as in treatment method 1 was achieved.

EXAMPLE II

Preparation of the Color-Recovering Agent

The compositions in Tables II-1 to II-2 were prepared in the same manner as in Example I except that the components (a-21) to (e-22) below were used.

(a-21): Amino-modified silicone (KF-8002, with a refractive index of 1.408, a viscosity of 1,100 $mm^2/s$ and an amino equivalent of 1,700 g/mol, Shin-Etsu Chemical Co., Ltd.)

(a-22): Amino-modified silicone (KF-8003, with a refractive index of 1.408, a viscosity of 1,850 $mm^2/s$ and an amino equivalent of 2,000 g/mol, Shin-Etsu Chemical Co., Ltd.)

(a-23): Amino-modified silicone (TSF-4707, with a refractive index of 1.405, a viscosity of 10,000 $mm^2/s$ and an amino equivalent of 7,000 g/mol, GE Toshiba Silicones)

(a-24): Modified silicone (refractive index 1.441) having a poly(N-acylalkylene imine) chain introduced into it obtained in Production Example 1 below.

PRODUCTION EXAMPLE 21

29.7 g (0.193 mole) diethyl sulfate and 153 g (1.54 mole) 2-ethyl-2-oxazoline were dissolved in 370 g dehydrated ethyl acetate in a nitrogen atmosphere and heated under reflux for 3 hours to give terminal-reactive poly(N-propionyl ethylene imine). Then, 50% ethyl acetate solution containing 300 g (0.160 mole based on the amino group) side-chain primary aminopropyl-modified polydimethyl siloxane (molecular weight 9,000; amine equivalent 1870) was added thereto in one portion and heated under reflux for 12 hours. The reaction mixture was concentrated under reduced pressure, whereby an N-propionyl ethylene imine-dimethyl siloxane copolymer was obtained as a pale yellow rubber solid (468 g, yield 97%). The content of dimethyl polysiloxane was 61%, and the weight-average molecular weight was 102,000. By neutralization titration with hydrochloric acid in methanol as the solvent, it was-confirmed that the amino group did not remain.

(a'-21): Modified silicone (KF-354, with a refractive index of 1.460 and a viscosity of 130 $mm^2/s$, Shin-Etsu Chemical Co., Ltd.) having a polyether group introduced into it (b-21): The compound obtained in Production Example 22 below, represented by the following formula:

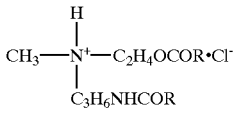

wherein R is a residue derived from hardened tallow fatty acid by removing its carboxyl group.

(b-22): The compound obtained in Production Example 22 below, represented by the following formula:

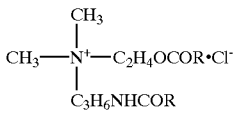

wherein R is a residue derived from hardened tallow fatty acid by removing its carboxyl group.

PRODUCTION EXAMPLE 22

(b-21) and (b-22) were produced by the following methods (22-1) and (22-2).

(22-1) 66 g of N-(2-hydroxyethyl)-N-methyl-1,3-propylene diamine synthesized from an adduct of N-methylethanolamine with acrylonitrile by a known method [J. Org. Chem., 26, 3409 (1960)], and 284 g hardened tallow fatty acid, were charged into a flask and heated to 180° C. The mixture was heated at that temperature for about 10 hours while formed water was distilled away, whereby 300 g reaction product based on the compound (b-21) was obtained. The acid value, saponification value, hydroxyl value, total amine value and tertiary amine value of the resultant reaction product were measured, and the composition of the reaction product was examined, indicating that the reaction product consisted of 86 weight % of dialkyl derivative, 10 weight % of monoalkyl amide derivative and 4 weight % of unreacted fatty acid. Analysis by gas chromatography indicated the unreacted N-(2-hydroxyethyl)-N-methyl-1,3-propylene diamine was contained in an amount of 0.1 weight % in the reaction product.

(22-2) 300 g compound obtained in (22-1) above was dissolved in 60 g industrial alcohol containing 8-acetylated sucrose and then introduced into an autoclave, and after 0.15 g 2,6-di-tert-butyl-p-cresol (BHT) was added thereto, 28 g methyl chloride was injected into the mixture. The mixture was reacted at 100° C. for about 8 hours, whereby 390 g reaction product based on the compound (b-2) was obtained. The solid content of the reaction product was 85% by weight, and the degree of quaternarization reaction, as determined by measuring the amine value thereof, was 96%. The non-quaternarized amine dialkyl derivative/monoalkyl amide derivative ratio was 85/15 (ratio by weight).

(b-23) The compound obtained in Production Example 23 below, represented by the following formula:

R—NH—$(C_2H_4NH)_n$—H wherein R is a hydrocarbon group derived from palm seed oil.

PRODUCTION EXAMPLE 23

21.4 g (0.139 mole) diethyl sulfate and 1.39 moles of 2-oxazoline were dissolved in 700 g dehydrated ethyl acetate in a 2-L four-necked flask and then heated under reflux for 5 hours in a nitrogen atmosphere. Then, 444 g (1.11 moles) of 50% ethyl acetate solution of a primary amine having an alkyl composition derived from palm seed oil was added thereto, and after the mixture was heated under reflux for 10 hours, the ethyl acetate was distilled away under reduced pressure from the reaction mixture. Then, amide linkages in 400 g of the resultant compound were hydrolyzed, and propionic acid produced as a byproduct was removed, whereby compound (b-23) was obtained. The average degree of polymerization was 8 moles and the yield was 95%.

(b-24): Cetyl trimethyl ammonium chloride (Cortamine 60 W, Kao Corporation)

(b-25): Dehydrating esterification reaction product of 1 mole of glycerin and 2 moles of fatty acids having a hardened tallow composition (b-26): Dehydrating amidation reaction product of 1 mole of citric acid and 2 moles of stearyl amine (b-27): Dehydrating condensation reaction product of 1 mole of hydroxy ethyl ethylene diamine and 2 moles of fatty acids having a hardened tallow composition (d-21): Propylene glycol (e-21): Adduct having 5 moles of ethylene oxide added to lauryl alcohol (Emurgen 105, Kao Corporation)

(e-22): Adduct having 5 moles of ethylene oxide added to $C_{12-14}$ secondary alcohol.

Preparation of Faded Clothes

Commercial two navy blue polo shirts (100% cotton) were washed with a weakly alkaline detergent in a washing machine (two-chamber washing machine VH-360S1 produced by Toshiba; detergent concentration, 0.0667% by weight; tap water was used; strong stirring; bath ratio, 1/50 (30 L water); water temperature, 20° C.; washing for 10 minutes→dehydration for 1 minute→rinsing (1) with water for 2 minutes→dehydration for 1 minute→rinsing (2) with water→dehydration for 1 minute). After this procedure was carried out 7 times, the clothes lost the initial color, to turn whitish as a whole. These clothes were used as faded clothes. The weakly alkaline detergent used had an average particle diameter of 500 μm (from which particles of 125 μm or less in diameter and particles of 1,000 μm or more in diameter had been removed), an apparent bulk density of 700 g/cm$^3$ and a composition consisting of 22 weight % sodium linear ($C_{12-13}$) alkyl benzene sulfonate, 5 weight % sodium lauryl sulfate, 4 weight % sodium myristate, 5 weight % polyoxyethylene lauryl ether (having 8 molecules on average of ethylene oxide added thereto), 8 weight % sodium silicate No. 1, 5 weight % sodium polyacrylate (weight average molecular weight: 10,000), 15 weight % type A zeolite, 15 weight % sodium carbonate (soda ash), 3 weight % potassium carbonate, 0.5 weight % protease (Sabinase 12.0T type-W, produced by Novonordisk), 0.5 weight % cellulase (KAC500 produced by Kao Corporation) and 17 weight % sodium sulfate anhydride ("weight %" is based on the weight (excluding 7 weight % volatiles) of the detergent.).

Treatment Method 21 Was the Same as Treatment Method 1 Above.

TABLE II-1

| | | | Products of the invention | | | | | | | Comparative product | |
|---|---|---|---|---|---|---|---|---|---|---|---|
| | | | 21-1 | 21-2 | 21-3 | 21-4 | 21-5 | 21-6 | 21-7 | 21-1 | 21-2 |
| Color-recovering agent | Compounded components (weight %) | a-21 | 5 | | | 20 | | | | | |
| | | a-22 | | 10 | | | 10 | | 10 | | 10 |
| | | a-23 | | 10 | | | 10 | | 5 | | 10 |
| | | a-24 | | | 15 | | | 10 | | | |
| | | a'-21 | | | | | | | | 10 | |
| | | b-21 | | | | | | | 1 | | |
| | | b-22 | | | 1.5 | | | | | | |
| | | b-23 | | 2 | | | | | | 2 | |
| | | b-24 | 1 | | | | | | | | |
| | | b-25 | | | | 5 | | | | | |

TABLE II-1-continued

| | Products of the invention | | | | | | | Comparative product | |
|---|---|---|---|---|---|---|---|---|---|
| | 21-1 | 21-2 | 21-3 | 21-4 | 21-5 | 21-6 | 21-7 | 21-1 | 21-2 |
| b-26 | | | | | 3 | | | | |
| b-27 | | | | | | 1 | | | |
| d-21 | 5 | 5 | 5 | 5 | 5 | 5 | 5 | 5 | 5 |
| e-21 | 1 | 1 | 1 | 1 | 1 | 1 | 1 | 1 | 1 |
| e-22 | 1 | 1 | 1 | 1 | 1 | 1 | 1 | 1 | 1 |
| Ion-exchange water | Balance | Balance | Balance | Balance | Balance | Balance | Balance | Balance | Balance |
| Total | 100 | 100 | 100 | 100 | 100 | 100 | 100 | 100 | 100 |
| pH (20° C.) | 7 | 7 | 7 | 7 | 7 | 7 | 7 | 7 | 7 |
| (a)/(b) ratio by weight | 5/1 | 10/1 | 10/1 | 4/1 | 6.7/1 | 10/1 | 15/1 | 5/1 | — |
| Treatment method | Method 21 | Method 21 | Method 21 | Method 21 | Method 21 | Method 21 | Method 21 | Method 21 | Method 21 |
| Evaluation result | ○ | ○ | ○ | ○ | ○ | ○ | ○ | X | Δ |

(Note)
The pH was adjusted with 0.1 N aqueous acetic acid or 0.1 N aqueous sodium hydroxide.
The particle diameter of the particles in each color-recovering agent in an emulsified state was in the range of 0.02 to 2 μm.
In Comparative Product 21-1, the ratio to a'-21 is expressed as (a)/(b) for convenience' sake.

Treatment Method 22

The above faded clothes were washed and rinsed with a combination of a weakly alkaline detergent (the same as the one used in preparation of the faded clothes; the concentration of the detergent, 0.0667 weight %) and the color-recovering agent (0.3 weight %) in Table II-2 in a washing machine under the same conditions as in preparation of the above faded clothes. To clarify the color-recovering effect, this procedure was repeated 7 times. The faded clothes were compared with faded clothes as the control washed 7 times without using the color-recovering agent in Table 2 and evaluated under the evaluation criteria in treatment method 1. The results are shown in Table II-2.

TABLE II-2

| | | | Products of the invention | | | | | | | | Comparative product | |
|---|---|---|---|---|---|---|---|---|---|---|---|---|
| | | | 22-1 | 22-2 | 22-3 | 22-4 | 22-5 | 22-6 | 22-7 | 22-8 | 22-1 | 22-2 |
| Color-recovering agent | Compounded components (weight %) | a-21 | 5 | | | | | | | | | 10 |
| | | a-22 | | | | 20 | | 15 | 5 | | | 10 |
| | | a-23 | | 10 | 15 | | 10 | | 10 | 10 | | |
| | | a-24 | 5 | 10 | | | 10 | | | | | |
| | | a'-21 | | | | | | | | | 15 | |
| | | b-21 | | | | 3 | | | 1 | | 2 | |
| | | b-22 | | | 1 | | | | | | | |
| | | b-23 | | 3 | | | | 1 | | | | |
| | | b-24 | 2 | | | | | | | 2 | | |
| | | b-25 | | | | | 2 | | 1 | | | |
| | | b-26 | | | | | 1 | | | | | |
| | | b-27 | | | | | | 1 | | | | |
| | | d-21 | 5 | 5 | 5 | 5 | 5 | 5 | 5 | 5 | 5 | 5 |
| | | e-21 | 1 | 1 | 1 | 1 | 1 | 1 | 1 | 1 | 1 | 1 |
| | | e-22 | 1 | 1 | 1 | 1 | 1 | 1 | 1 | 1 | 1 | 1 |
| | | Ion-exchange water | Balance | Balance | Balance | Balance | Balance | Balance | Balance | Balance | Balance | Balance |
| | | Total | 100 | 100 | 100 | 100 | 100 | 100 | 100 | 100 | 100 | 100 |
| | | pH (20° C.) | 7 | 7 | 7 | 7 | 7 | 7 | 7 | 7 | 7 | 7 |
| | | (a)/(b) ratio by weight | 5/1 | 6.7/1 | 15/1 | 6.7/1 | 6.7/1 | 7.5/1 | 7.5/1 | 5/1 | 7.5/1 | — |
| Treatment method | | | Method 22 | Method 22 | Method 22 | Method 22 | Method 22 | Method 22 | Method 22 | Method 24 | Method 22 | Method 22 |
| Evaluation result | | | ○ | ○ | ○ | ○ | ○ | ○ | ○ | ○ | X | Δ |

(Note)
The pH was adjusted with 0.1 N aqueous acetic acid or 0.1 N aqueous sodium hydroxide.
The particle diameter of the particles in each color-recovering agent in an emulsified state was in the range of 0.02 to 2 μm.
In Comparative Product 22-1, the ratio to a'-21 is expressed as (a)/(b) for convenience' sake.

<Treatment method 23>was the same as treatment method 3 described above.

Treatment Method 24

One suit (300 g) of the faded clothes was placed in a two-chamber washing machine VH-360S1 produced by Toshiba under the conditions of strong stirring and 30 L tap water, and after 60 g color-recovering agent in Table 11-2 was introduced into it, the clothes were washed under stirring for 5 minutes. The treatment solution was discharged, and the clothes were dehydrated for 3 minutes in a dehydrating chamber in the washing machine and dried for 12 hours in a room. Recovery of the color of the clothes after the treatment was compared with that of the faded clothes (control) before the treatment and evaluated in the same manner as in treatment method 1. The results are shown in Table II-2.

What is claimed is:

1. A method of color-recovering a colored cloth by soaking said colored cloth with a composition which comprises (a) a water-insoluble an amino-modified silicone compound having an amino equivalent of 1500 to 40,000 g/mol with a refractive index of 1.20 to 1.45 at 25° C., (b) a compound with a molecular weight of 300 to 1000, having, in the molecule thereof, at least one of a quaternary ammonium group and a tertiary amino group and at least one of a $C_{10-36}$ alkyl group and a $C_{10-36}$ alkenyl group and (c) water, wherein the ratio by weight of (a)/(b) is in the range of 3/1 to 100/1 for a time sufficient to recover said color.

2. The method according to claim 1, wherein said composition further comprises (d) a non-aqueous medium.

3. The method according to claim 1 wherein said composition further comprises (d) a non-aqueous medium and (e) an emulsifier.

4. The method according to claim 1, wherein said composition includes a detergent present in a positive amount of up to 900 ppm based on the total weight of said composition.

5. The method according to claim 1, wherein said composition includes a detergent present in a positive amount of up to 700 ppm based on the total weight of said composition.

6. The method according to claim 1, wherein said composition includes a detergent present in a positive amount of up to 500 ppm based on the total weight of said composition.

7. The method according to claim 1, wherein said composition comprises a detergent.

8. The method according to claim 7, wherein said detergent is an alkaline detergent.

9. The method according to claim 1, wherein said composition comprises from 5 to 50 percent by weight of component (a), based on the total amount of components (a), (b), and (c), and said method further comprises a soaking bath ratio of said colored cloth to said composition within the range of from 1:2 to 1:500.

10. The method according to claim 1, wherein component (a) has an amino equivalent of 2500 to 20,000 g/mol.

11. The method according to claim 1, wherein component (a) has an amino equivalent of 3000 to 10,000 g/mol.

12. The method according to claim 1, wherein said composition comprises from 5 to 50 percent by weight of component (a).

13. A method of color-recovering a colored cloth by contacting said colored cloth with a color-recovering composition in washing or rinsing water when the colored cloth is being washed or rinsed, respectively, said composition comprising (a) an amino-modified silicone compound having an amino equivalent of 1500 to 40,000 g/mol with a refractive index of 1.20 to 1.45 at 25° C., (b) a compound with a molecular weight of 300 to 1000, having, in the molecule thereof, at least one of a quaternary ammonium group and a tertiary amino group and at least one of a $C_{10-36}$ alkyl group and a $C_{10-36}$ alkenyl group, and (c) water, wherein the ratio by weight of (a)/(b) is in the range of 3/1 to 100/1, and said composition being added to said washing or rinsing water in an amount effective to recover said color.

14. The method according to claim 13, wherein component (a) has an amino equivalent of 2500 to 20,000 g/mol.

15. The method according to claim 13, wherein component (a) has an amino equivalent of 3000 to 10,000 g/mol.

16. The method according to claim 13, wherein said composition comprises from 5 to 50 percent by weight of component (a), based on the total amount of components (a), (b) and (c).

* * * * *